United States Patent [19]

Parera

[11] 4,099,303

[45] Jul. 11, 1978

[54] SNAP FASTENER

[76] Inventor: Pedro Pere Parera, 79-81 Pablo Alcover St., Barcelona-17, Spain

[21] Appl. No.: 786,089

[22] Filed: Apr. 11, 1977

[30] Foreign Application Priority Data

Feb. 15, 1977 [ES] Spain ..... 226.417

[51] Int. Cl.[2] ..... A44B 17/00

[52] U.S. Cl. ..... 24/217 R

[58] Field of Search ..... 24/217, 216, 219, 95, 24/96, 211 M, 108

[56] References Cited

U.S. PATENT DOCUMENTS

| | | | |
|---|---|---|---|
| 487,175 | 11/1892 | Courcel | 24/217 |
| 2,371,813 | 3/1945 | Fenton | 24/216 |
| 2,908,059 | 10/1959 | Domenech et al. | 24/217 |
| 3,538,557 | 11/1970 | Hirose | 24/217 |
| 3,769,664 | 11/1973 | Parera | 24/217 |

*Primary Examiner*—Kenneth J. Dorner

*Attorney, Agent, or Firm*—Blanchard, Flynn, Thiel, Boutell & Tanis

[57] ABSTRACT

A snap fastener having male and female parts. The female part comprises two ringlike elements placed on the top and bottom of a flexible lamina. One of these elements has lungs which penetrate the lamina and are guided by a cylindrical part of the opposed element and are folded to the exterior by a conical-shaped part. The upper element is formed by two united pieces, and contains in its interior a movable push-button for opening the fastener. The lower element is composed of two united portions which form a cylindrical-shaped receptacle with upper and lower openings disposed to contain a locking piece having a reversible arched portion movable between opposed stable positions. When the male part is introduced through the lower opening, it contacts the locking piece and exerts pressure thereon so that the direction of the arched portion changes, this movement being transmitted to fingers which move into a groove which encircles the male part.

6 Claims, 6 Drawing Figures

SNAP FASTENER

BACKGROUND OF THE INVENTION

The present invention deals with a snap fastener comprising male and female elements in the form of a button, which fastener is used to unite two generally flexible laminae, such as fabrics, garments, tent cloths and the like.

The snap fastener of this invention has been improved in an extraordinary manner, overcoming the disadvantages of the known fasteners, inasmuch as same cannot be opened accidentally, for instance by the effect of involuntary forces or pulls exerted on the united sheets. The improved snap fastener thus assures a perfect closing of the garments or other articles, without the possibilty of an undesired occasional opening. Nevertheless, if desired, the improved snap fastener can be opened easily, operating like a pushbutton, attaining thereby the quick disengagement of the male and female elements without the necessity to pull the laminae or exert forces towards the sides, such as normally happens with known fasteners when they have to be opened in order to separate the laminae.

It is also an object of the present invention to place the snap fastener on any flexible lamina without having to make a hole in the lamina, thereby simplifying the mounting operation.

In the present invention, the two exterior parts forming the female element have clamps and pins which go through the flexible lamina, whereby the holes caused by the perforation of the lamina are hidden because of the piercing clamps and pins being positioned inwardly from the border of the element. More specifically, the snap fastener of this invention is characterized by the fact that the female element is constituted by two elements, namely an upper piece placed on the top of the flexible lamina and a lower piece placed below the same and both in perfect coincidence.

The upper element includes an exterior visible piece of cylindrical shape, which piece is folded in the way of a curl on the edge so as to form a flange for the inner piece, thereby attaining the engagement of both pieces which form a receptacle or box with central openings in the upper and lower parts, so that in its interior there can be clamped a pushing element to facilitate the opening operation of the snap fastener. Said pushing element can adopt the most practical and useful forms to guarantee an ulimited lifetime and an easy and acceptable touch.

The inner piece is provided with a cylindrical part (to guide the piercing clamps), followed by a conical-shaped part (to fold said clamps or legs) and afterwards with a peripheral wing on which is engaged the curl of the exterior piece, leaving the necessary and sufficient space so that the folded clamps or pins can be properly placed.

The lower element of the female part is also formed by two substantially cylindrical pieces coupled together by a curl on the edge of the outside cylindrical piece, which pieces form a receptacle or box with openings in the upper and lower parts, which receptacle is adapted to contain and engage therein a third piece described herebelow.

The inside cylindrical piece of his lower element has, near its periphery triangular teeth or pins disposed vertically and positioned to perforate the flexible lamina, being inserted into the upper piece by pressure between both elements, whereby these elements are fixedly mounted to the flexible lamina.

The above-mentioned third piece consists of a disc made of a flexible (resilient) material and formed of a crownlike shape. On the disc periphery are lugs which extend at a right angle with respect to the surface of the disc, which lugs have inwardly extending fingers on the ends thereof.

This flexible disc can assume the form of an inwardly or outwardly arched piece, depending on whether a force is exerted from the top or the bottom, passing in the first case from concave to convex and vice versa in the second case, being both perfectly stable positions and entraining in their movement the lugs which are being moved towards or away from the center of the disc. When moving toward the center, the fingers of the lugs enter into a peripheral groove on the male piece of the fastener, remaining engaged therewith. By exerting pressure on the upper part or by the pusher, the flexible disc passes over center, whereby the lugs are moved away from the groove in the male element, thereby liberating same.

The above description will be more fully appreciated by reference to the following detailed description of an embodiment in accordance with the present invention when taken in conjunction with the accompanying drawings.

DETAILED DESCRIPTION

Figure 3:
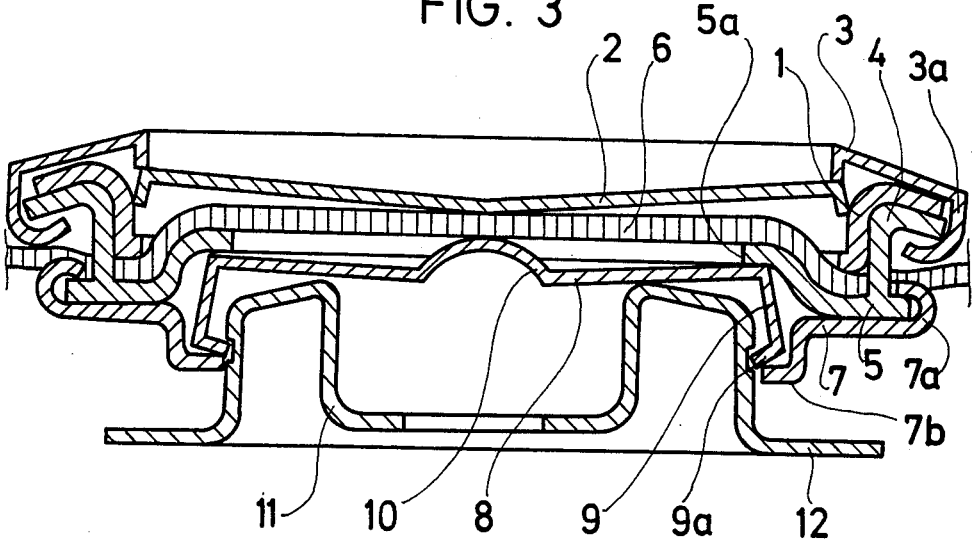
FIGS. 3 and 4 respectively correspond to FIGS. 1 and 2 but show a different pusher piece.
Figure 4:
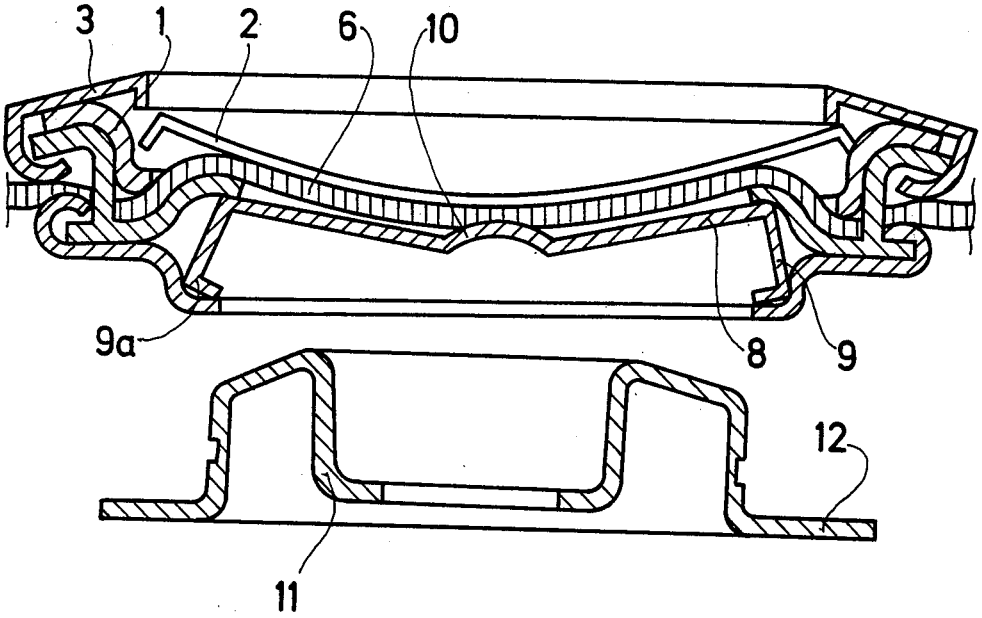

Referring to the drawings, there is shown an improved snap fastener which includes a ring-shaped piece 1 which has an inner cut-down portion to guidably receive therein a disc 2. This disc 2 may be rigid or flexible as shown respectively in FIGS. 1 and 3. The edge of disc 2 is covered by a ring-like rim 3 which has a border **3*a* which curls over towards the bottom and is folded to the inside. Into the border 3*a* are fitted a series of pins 4 which encircle a ring 5. The pins 4 pass through a flexible fabric or lamina 6 interposed between the ring 5 and the annular piece 1, and on which is applied the folded border 3*a* of the rim 3, so that the female element is fixed to the flexible lamina 6. The female element also includes a loop 7 which has a curled border 7*a* fitted onto the wing or edge of the ring 5. The loop 7 has an inner step 7*b* which supports a discoidal flexible piece 8. This piece 8 has a series of inclined surrounding legs 9. The edge of piece 8, adjacent the upper ends of the legs, bears against the inner lip 5*a* of the ring 5**.

The illustrated snap fastener, to increase the comfort and facility of being opened, has a relief 10 in a suitable shape and size in the central part of the piece 8.

The snap fastener also includes a male element 11 constituted by a stamped-out laminar sheet metal cylindrical member having an encasing lug 12 for fixing the element 11 to a second flexible lamina fabric (not shown).

In operation, the male element 11 is introduced into the female element through the central hole formed at the bottom of the ring 7, with the male element 11 being pushed against the disc 8. This causes the disc 8 to be resiliently fixed upwardly from its lowermost stable position into an uppermost stable position. This flexing of the disc 8 causes the legs 9 to be swung inwardly toward the male element, whereupon the fingers 9*a* thus enter into the annular groove which is formed in and externally surrounds the male element. These fingers cause the male element to be fixedly locked to the female element, and the fastener thus securely holds the two laminae together. Further, the snap fastener cannot be accidentally disconnected due to tensions imposed on the laminae, or due to a pulling force exerted between the male and female elements.

When separation of the snap fastener is desired, the button or disc 2 is pushed downwardly, and this pushing force is transmitted through the lamina 6 onto the disc 8. This downward pushing force causes the disc 8 to resiliently snap over from its upper stable position into its lower stable position. As a consequence of this movement of disc 8, the legs 9 are pivoted outwardly and cause the fingers 9*a* to be withdrawn from the external groove formed in the male element. The male element is thus released and hence can be withdrawn from the female element.

Figure 1:
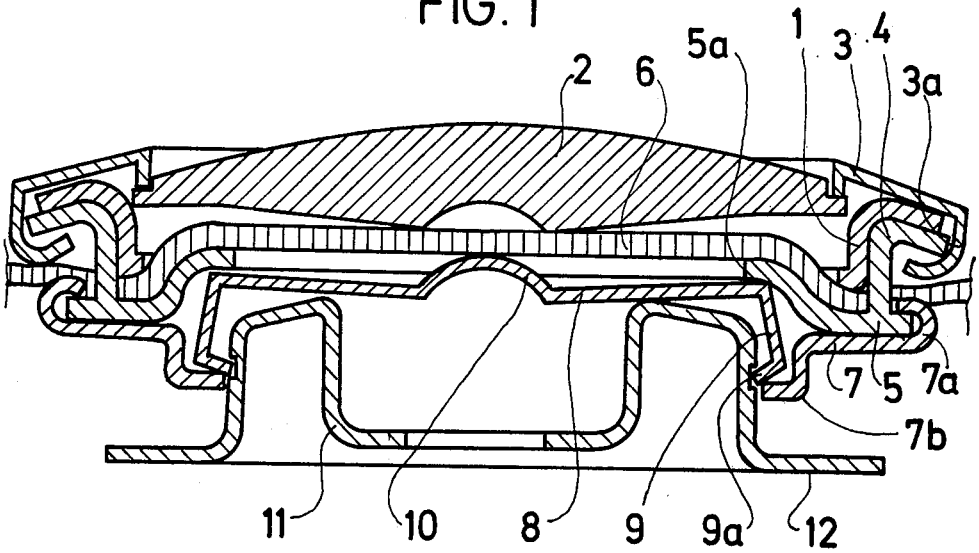
FIG. 1 is a diametrical cross-sectional view of the closed snap fastener with the female element joined to the corresponding lamina.
Figure 2:
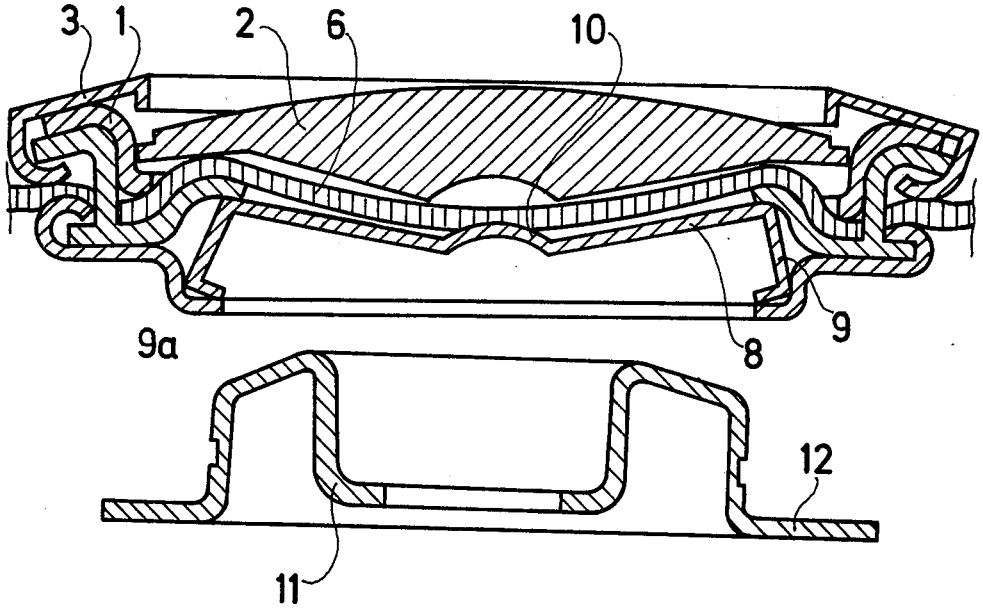
FIG. 2 is a diametrical cross-sectional view showing the disengagement of the fastener.
Figure 5:
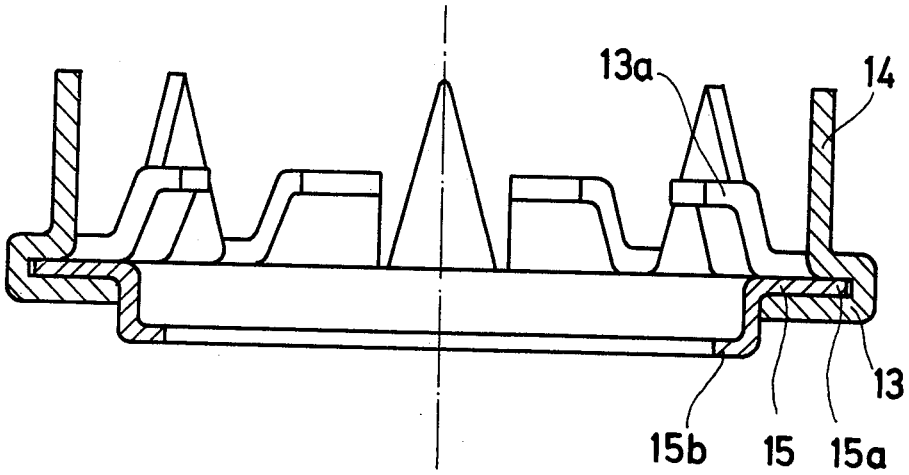
FIGS. 5 and 6 both show variations in the structure of the female piece of the snap fastener, as shown in a diametrical cross-sectional view.

According to a variation (FIG. 5), the female element instead of the ring 5 of FIG. 1 consists of a ring provided with a series of encircling pointed clamps 14 which pass through the flexible lamina and fit into the border 3*a* of the rim 3 (FIG. 1). This female element 13 has, instead of the ring 7, an inner hoop 15 with a peripheral flange 15*a* on which bears the ring 13. Hoop 15 has a stepped shoulder 15*b* towards the interior thereof (in substitution of the inner stair 7*b* of the ring 7 in FIG. 1).

The material of the interior hoop 15 between each pair of clamps 14 is folded towards the inside, forming a stair 13*a* so that the flexible discoidal piece 8 is fixed between the stairs 15*b* of hoop 15 and stairs 13*a* of piece 13. The snap fastener thus works in the same manner described above when the male piece is introduced through the central hole of the hoop 15.

Figure 6:
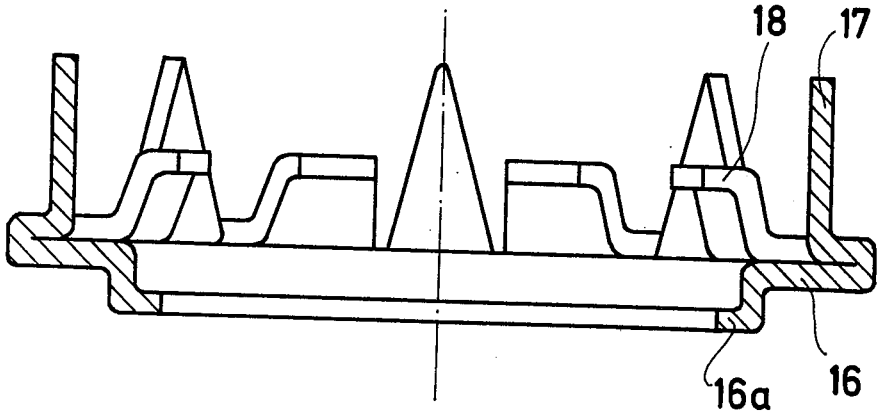

Further, the female element, instead of being formed from separate rings 5 and 7, can be single ring 16 (FIG. 6) with a series of encircling pointed clamps 17 which are clipped within the folded border 3*a* of the rim 3, which clamps penetrate the flexible lamina 6. Between each of the clamps a small portion of material is bent to form a stair 18. The discoidal piece 8 is supported between stairs 18 and 16*a*.

The improved snap fastener subject of this invention is fixed to the flexible lamina 6 without the necessity of having to cut an opening in the lamina. This fixation is realized simply by means of the pointed clamps which penetrate the lamina and fit complementarily into the folded border of a rim.

From the aforesaid it should be readily appreciated that the snap fastener operates very advantageous in comparison with the already known ones, as this new snap fastener cannot be opened by pulling or involuntary tensions on the lamina. Opening the same in a convenient manner can occur only by pressing on the cited disc 2 or directly on the relief 10 of the discoidal piece 8.

Although a particular preferred embodiment of the invention has been disclosed in detail of illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. An improved snap fastener for permitting first and second laminae to be releasably secured together, said snap fastener comprising a female part which is fixable to the first lamina without having to preform a hole therein and a male part which is fixable to the second lamina, comprising the improvement wherein:

said female part includes a first ring means which is fixedly positioned adjacent one side of said first lamina, said first ring means including a substantially cylindrical part which projects away from the first lamina and defines therein a central opening, the cylindrical part terminating in an annular conical part which flares radially outwardly from the cylindrical part;

said female part including a push button movably positioned within said cylindrical part;

said female part including second ring means disposed adjacent the other side of said first lamina, said second ring means having a plurality of pinlike lugs which penetrate through the first lamina and are slidably guided past the exterior surface of the cylindrical part and are bent outwardly beneath the conical part of said first ring means;

said female part including third ring means which overlies the first ring means and has an outer flange portion which wraps around the radially outer edge of said conical part and the outer ends of said lugs for fixedly connecting said first, second and third ring means together, said third ring means having a central opening which permits a finger to be inserted therethrough so as to contact the push button;

said second ring means having first and second portions which are positioned on said other side of the first lamina, said first and second portions being axially spaced apart so that said first portion is positioned closely adjacent said first lamina whereas said second portion is spaced therefrom, said first and second portions respectively defining first and second openings which communicate with an enlarged receptacle defined therebetween;

said female part further including a locking member positioned within said receptacle and confined between said first and second portions, said locking member including a resilient reversible disc which is resiliently flexibly movable between raised and lowered stable positions, said locking member further including legs connected to said disc and projecting axially therefrom toward said second portion, said legs terminating in locking projections; and said male part including a portion insertable through said second opening so as to engage said disc, the portion of said male part having a groove formed for engagement with said locking projections.

2. An improved snap fastener according to claim 1, wherein said first and second portions are respectively formed by first and second ringlike pieces which are fixedly connected together and define said receptacle therebetween, the first ringlike piece having said pinlike lugs formed thereon and projecting through said first lamina, said lugs being disposed in a circular pattern and spaced inwardly from the outer edge of the first piece so that the latter has a radially outwardly projecting flange, and the second ringlike piece having an outer curled flange portion which wraps around the flange on said first piece, whereby the pinlike lugs which penetrate the first lamina are completely concealed when the female part of the fastener is mounted on the first lamina.

3. An improved snap fastener according to claim 1, wherein the first and second portions associated with said second ring means are integrally formed as a single piece, said first and second portions comprising a pair of annular rims which are axially spaced apart, one of said rims defining the mouth of the female part, and the other rim defining a bearing lip for engagement with the disc of the locking member.

4. An improved snap fastener according to claim 1, wherein the disc of the locking member has a projection formed centrally thereof and projecting toward said first lamina to facilitate pushing thereof upon opening of the snap fastener.

5. An improved snap fastener according to claim 4, wherein the push-button is rigid and has a slightly inverted conicallyshaped lower surface, in the vertex of which there is formed a cavity having a shape compatible to that of the central projection formed on the disc of the locking member.

6. An improved snap fastener for permitting first and second laminae to be releasably secured together, said snap fastener comprising a female part which is fixedly secured to the first lamina and a male part which is fixedly secured to the second lamina, comprising the improvement wherein:

said female part includes a first ring means which is fixedly positioned adjacent one side of said first lamina, said first ring means including a substantially cylindrical part which projects away from the first lamina and defines therein a central opening, the cylindrical part terminating in an annular conical part which flares radially outwardly from the cylindrical part;

said female part including a push-button movably positioned within said cylindrical part;

said female part including second ring means disposed adjacent the other side of said first lamina, said second ring means having a plurality of toothlike projections which penetrate through the first lamina and are slidably guided past the exterior surface of the cylindrical part and are bent outwardly beneath the conical part of said first ring means;

said female part including third ring means which overlies the first ring means and has an outer flange portion which wraps around the radially outer edge of said conical part and the outer ends of said toothlike projections for fixedly connecting said first, second and third ring means together, said third ring means also having an inner edge portion which projects radially inwardly to at least partically overlap at least the radially outer edge of said push button to confine the latter within the cylindrical part, said third ring means having a large central opening which permits a finger to be inserted therethrough so as to contact the push button;

said second ring means having first and second projection means which extend inwardly from the toothlike projections and are positioned on said other side of the first lamina, said first and second projection means being axially spaced apart so that said first projection means is positioned closely adjacent said first lamina whereas said second projection means is spaced therefrom, said first and second projection means being approximately annular and respectively defining first and second openings which communicate with an enlarged receptacle defined between the first and second projection means;

said female part further including a resilient cuplike locking member positioned within said receptacle and confined between said first and second projection means, said cuplike locking member opening outwardly toward said second opening;

said locking member including resilient disc-like base portion which is positioned adjacent the first lamina and has the outer edge thereof seated on said first projection means, said resilient base portion being resiliently flexibly movable between raised and lowered stable positions;

said locking member further including legs fixedly connected to said base portion adjacent the outer edge thereof and projecting axially therefrom toward said second projection means, the free ends of said legs being supported on said second projection means, and said legs terminating in locking projections which project radially inwardly toward said second opening; and said male part including a cylindrical portion having a diameter slightly smaller than said second opening and being insertable through said second opening so as to engage said disc-like base portion, and the cylindrical portion of said male part having an annular groove formed therein and extending exteriorly therearound;

whereby insertion of said male part through said second opening and pressing of this male part against said disc-like base portion causes it to resiliently snap from its lowered stable position into its upper stable position, whereupon the legs swing inwardly so that the locking projections enter into the groove formed in the male part to fixedly lock the male and female parts together, whereby pulling on the laminae or on the male and female parts will not permit separation thereof, the male and female parts being separable only by pressing downwardly on the push button whereby the pressing force is transmitted through the first lamina onto the disc-like base portion which moves downwardly into its lowered stable position causing the locking projections to be removed from the exterior groove formed in the male part.

* * * * *